US005265283A

United States Patent [19]

Pourcier

[11] Patent Number: 5,265,283

[45] Date of Patent: Nov. 30, 1993

[54] FLUSHING MECHANISM HAVING A SUBMERSIBLE FLOAT CONTROLLED BY A PUSH BUTTON

[75] Inventor: Michel Pourcier, Marseille, France

[73] Assignee: Societe Phoceenne de Matieres Plastiques S.P.M.P. s.a., Marseille, France

[21] Appl. No.: 741,946

[22] Filed: Aug. 8, 1991

[51] Int. Cl.[5] ..... E03D 5/09

[52] U.S. Cl. ..... 4/410; 4/415

[58] Field of Search ..... 4/395, 397, 398, 403, 4/405, 410, 411, 413, 414, 415

[56] References Cited

U.S. PATENT DOCUMENTS 4,858,251 8/1989 de Belaunde ..... 4/414 X

FOREIGN PATENT DOCUMENTS 0103045 3/1984 European Pat. Off. .
0124458 11/1984 European Pat. Off. .
0128847 12/1984 European Pat. Off. .
2548328 1/1985 European Pat. Off. .
0209477 1/1987 European Pat. Off. ..... 4/395
0311542 4/1989 European Pat. Off. ..... 4/405
2580694 10/1986 France .
2591250 6/1987 France .
2658219 8/1991 France ..... 4/398

*Primary Examiner*—William A. Cuchlinski, Jr.
*Assistant Examiner*—W. Morris Worth
*Attorney, Agent, or Firm*—Sandler Greenblum & Bernstein

[57] ABSTRACT

Flushing mechanism for providing both complete release of water from a tank, as well as partial removal of the water. The flushing mechanism is provided with an external tubular envelope, an evacuation orifice, an axially displaceable member, a lifting member, and an axially displaceable blocking element. The displaceable member includes an evacuation tube, and a valve for blocking the evacuation orifice the evacuation tube. The lower portion of the evacuation tube comprises a float, and the float includes a seat. The lifting member includes a push button, a transmission rod capable of being pushed by the push button, a pusher element, a lifting element for lifting the displaceable member, and a joint attaching the element to a lower portion of the transmission rod. The blocking element is associated with the float, and is constructed and arranged to be applied against the seat when the element for lifting the displaceable member is displaced by pushing the push button or under pressure of water, and to be spaced from the seat by action of the pusher element so as to enable entry of water into the float so that the float is displaced and the valve seals the evacuation orifice.

20 Claims, 7 Drawing Sheets

Fig.8
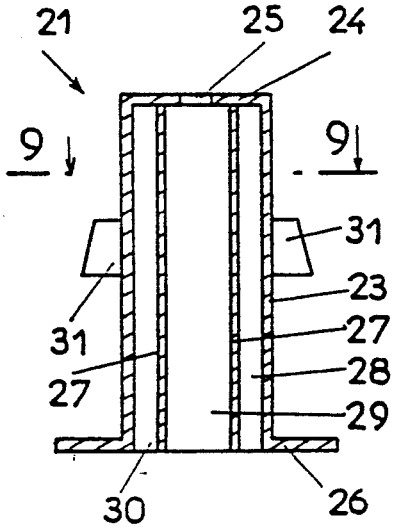
Fig.7
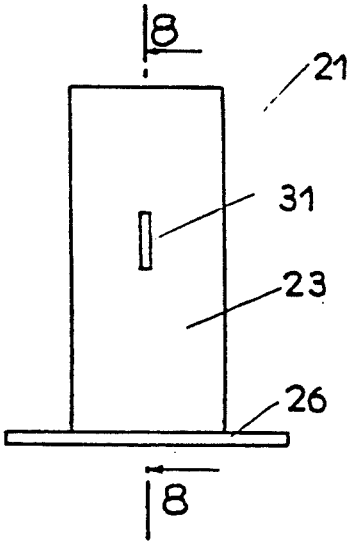
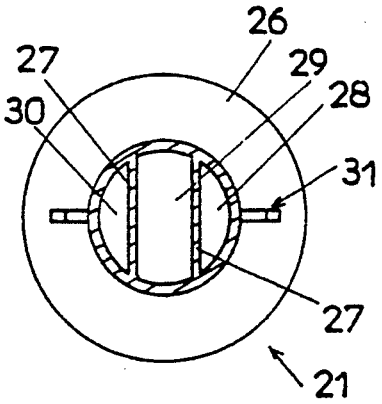
Fig.9

FLUSHING MECHANISM HAVING A SUBMERSIBLE FLOAT CONTROLLED BY A PUSH BUTTON

BACKGROUND OF THE INVENTION

1. Field of the Invention

The present invention relates to a flushing mechanism with a float, and controlled axially by a push button, for flushing tanks of toilets.

2. Discussion of Background Information

The invention concerns a flushing device of the type described in FR-A-2.580.694, and comprising a valve adapted to be applied on the edge of the evacuation orifice arranged in the base of the flushing tank. The valve is mounted at the lower end or at the lower portion of a tubular rod open at its opposite ends, so as to constitute an overflow tube enabling the evacuation of a possible over-filling that could, for example, result in a defective closure of the tap controlling the entry of water into the tank. A float is arranged above the valve and is, for example, constituted by the lower bulging portion of the rod. This flushing device also preferably comprises an external envelope comprising a lower bulging portion or external bell adapted to be fixedly installed in the tank, and in which the internal float is housed with an aptitude for axial movement.

Mechanisms of this type are easy to envision, and work in a very satisfactory manner. Moreover because their component parts are not subject to substantial forces, they can be economically produced by using any adequately rigid plastic material.

The lifting of the assembly or mobile equipment valve-tube of the float, that is, the opening of the emptying or evacuation orifice of the flushing tank, is obtained by means of a traction button or push button device, the latter having the advantage of being less exposed to being accidentally or deliberately torn off, and of being able to be more easily arranged so as to ensure that it cannot be reached.

Flushing mechanisms controlled by push buttons with vertical displacement are, for example, described in EP-A-0,124,458, EP-A-0,128,847, FR-A-2,591,250 and FR-A-2,580,694.

According to these mechanisms, after having pressed the control push button to start the rinsing process, the process can no longer be interrupted, and the valve only falls back on its seat after complete evacuation of the tank. Often desirable, such a result may also constitute a disadvantage when a quantity of water substantially less than the capacity of the tank would have been adequate to obtain a satisfactory rinsing of the bowl. The result is the use of excessive quantities of water, which is unfortunate both for the user and for the community.

Efforts have been made (FR-A-2,548,328) to overcome this disadvantage by an activation device for the outflow valve, comprising a control push button with vertical displacement, affixed to a pusher element being able to slide axially and pivot laterally in a limited manner, from either side of its sliding axis, so as to act on one or the other of the arms of a rocking lever, one of the arms of this lever being connected, by means of transmission elements, to the outflow valve, such that when the pusher element presses on one or another of the arms of the pivoting lever, an ascending traction action is exercised, bringing about the lifting of the valve, or a descending pushing action, bringing about a lowering of the valve in the direction of its seat.

This device enables the evacuation to be interrupted, but has the disadvantage of necessitating the use of a relatively large number of elements in order to ensure mechanical connection between the control push button and the outflow valve, and this complicates the construction of the flushing mechanisms and has a negative impact on manufacturing costs. On the other hand, these mechanical connection elements work with different movements (longitudinal movements, circular movements, or a combination of these two movements, and with substantial forces and rubbings, which means that the mechanism gets blocked and stuck more often).

SUMMARY OF THE INVENTION

The main object of the invention is to overcome these disadvantages by producing an extremely simple flushing mechanism, which preferably implements a control device with a vertically displaceable push button of the type described in FR-A-2,591,250, and by virtue of which there is no mechanical connection between the tubular rod bearing the valve and its lifting element, such that the movement of these mobile component parts of the flushing mechanism cannot mutually hinder each other.

According to the invention, this object is achieved by virtue of a flushing mechanism of the type described above, controlled by a push button. This flushing mechanism is improved due to the fact that the float is equipped with an axially and vertically mobile blocking device. This blocking device is pressed against its seat, which is formed by the edge of the lower orifice of the overflow tube, under the push of the lifting element of the valve, and under the pressure of water leaving the tank, or is distanced from the seat under the impulsion of a pusher element affixed to the transmission rod, so as to enable the water to enter into the float, bringing about its fall, and an interruption in the flushing process.

As is explained below, the flushing mechanism enables deliberate interruption of the evacuation of the flushing tank, when one judges that the washing or rinsing of the bowl is done before the entirety of the water contained in the tank is evacuated, that is, before the completion of the normal flushing process. Moreover, this flushing mechanism is extremely simple, such that it can be manufactured in a very economical manner, and of any appropriate plastic material, whereas all its mobile elements are displaceable coaxially, without rubbing, or at least very little rubbing, that is under conditions that favor a good and durable functioning of the mechanism.

BRIEF DESCRIPTION OF THE DRAWINGS

The aims, characteristics and advantages mentioned above, as well as others, will become more apparent from the description that follows and from the annexed drawings in which:

FIG. 7 is an elevational view of the blocking device equipping the float;

FIG. 8 is a longitudinal sectional view along line 8—8 of FIG. 7; and

FIG. 9 is a transverse sectional view along line 9—9 of FIG. 7.

DETAILED DESCRIPTION OF THE PREFERRED EMBODIMENTS

Figure 1:
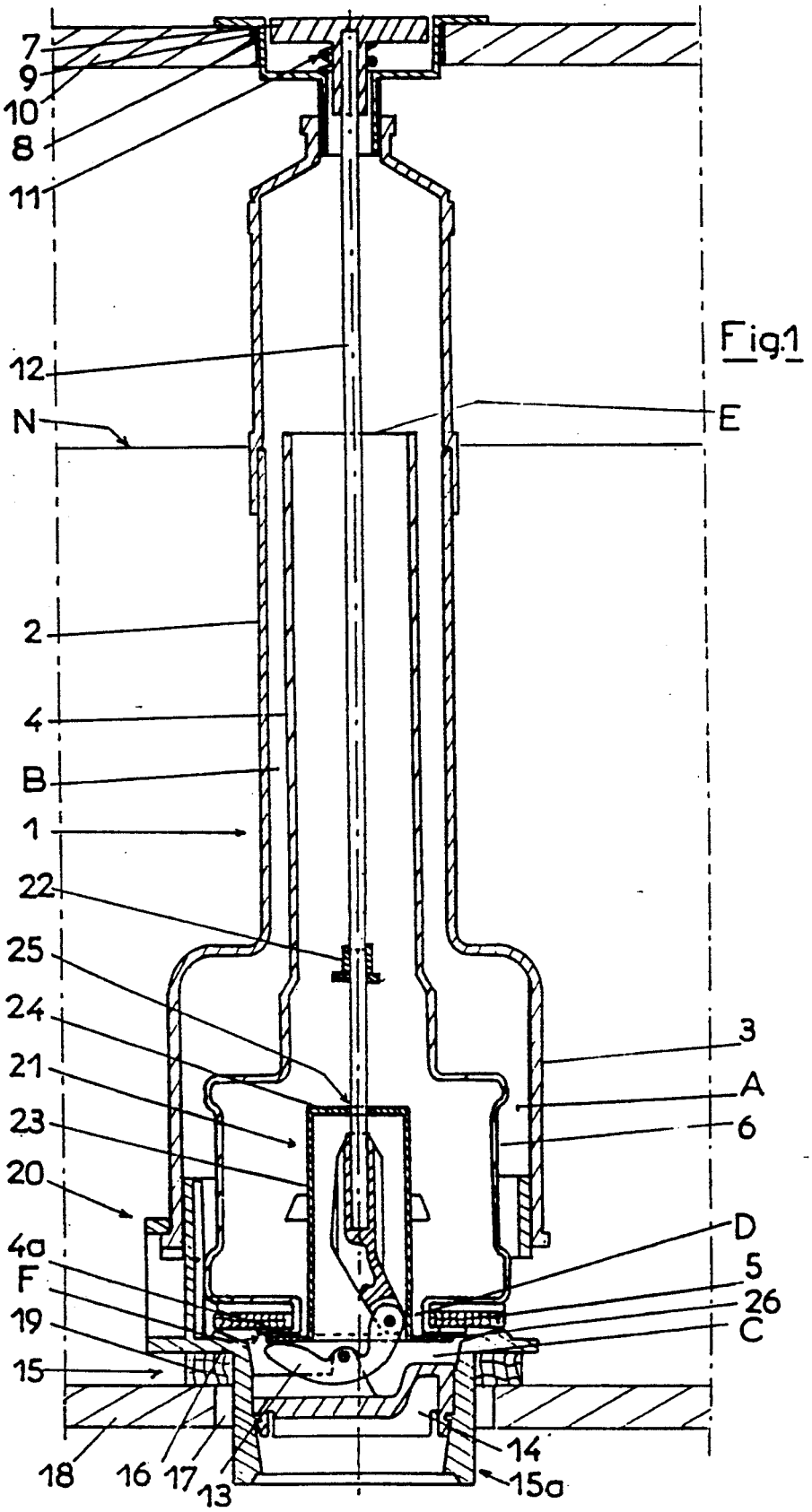
FIG. 1 is an axial sectional view of the flushing mechanism with submersible float and controllable action, according to the invention, shown installed in a flushing tank which is only partially represented with its base and its cover, the mechanism being in a resting position.

The drawings will be referred to in order to describe a preferred, non-limiting embodiment, of the flushing mechanism controlled by a push button and submersible float according to the invention.

This flushing mechanism comprises, in a known way, an external envelope designated in its assembly by the reference numeral 1, and comprising an upper cylindrical portion, or a vertical extension tube 2, and a lower bulging portion, or external bell 3, also cylindrical, and whose diameter is clearly greater than that of the extension tube 2; this external envelope is adapted to be fixedly installed in a flushing tank, as is described in the remainder of this application.

An "overflow" tube 4, comprising a lower orifice D and an upper orifice E is housed in the external envelope 1, with an aptitude for ascending and descending axial movements, so as to enable automatic discharge of a possible over-filling that could result in defective closing of the tap controlling entry of water in the tank. On the lower end of this tube a blocking valve 5 of the evacuation orifice of the tank is fixed. This valve, for example, is constituted by a water tight joint in the form of a circular crown, and is made of rubber or any similar material, and is installed in a peripheral neck presented in a mounting device 4*a* constituting the lower end of the overflow tube 4 and the edge of opening D.

The lower portion of the overflow tube is arranged so as to constitute a float, which may be advantageously formed by the lower bulging portion 6 of the tube, the base of this float being placed above, and at a reduced distance from the plane in which the upper surface of valve 5 is located.

The float 6 is housed, concentrically, in the external bell 3, and a space or annular passage A is reserved between the lateral cylindrical walls of these two elements.

The upper portion of the overflow tube 4 is housed, also concentrically, in the upper portion 2 of the external envelope 1, and an annular passage B is arranged between the lateral cylindrical walls of the tube and the upper portion.

The flushing device also comprises a push button control system that may be advantageously of the type as that has been illustrated in FR-A-2,591,250. This control system enables lifting of valve 5, and comprises:

a push button 7, axially and vertically mobile, this push button being housed in a plate 8, adapted to be fixedly installed in the hole 9 present in cover 10 of the flushing tank for the passage of the rod of the control device. This plate 8 is, for example, affixed to a tubular rod (non-represented) equipped with an external threading by means of which, it is screwed in a bolt constituted by the cap forming the peak of the external envelope 1;

a spring 11 acting in compression, and tending to push back the push button 7 upwardly towards the outside. This spring is, for example, wedged, by means of its opposing ends against the lower surface of the push button, and against the base of plate 8;

an axial transmission rod 12 affixed in axial translation to the push button 7 and which may be connected to it by means of its upper end. This transmission rod longitudinally crosses the mobile equipment 4-5-6; and a lifting element 13 pivotably mounted at the lower end of the transmission rod 12 and arranged below valve 5; This element is, for example, constituted by a cam or a small lever whose oscillation axis is carried by a traverse 14 fixedly arranged through the evacuation orifice of the tubular cap described hereafter, below the seat of the valve.

This tubular cap is designated in its assembly, by the reference numerical 15, and comprises a central orifice C whose upper circular edge 16 constitutes the seat of valve 5.

When the flushing mechanism is positioned inside the flushing tank, itself fixed on a toilet bowl, the tubular cap 15 is fixedly installed, by means of a bolt (non-represented) being screwed on the lower cylindrical threaded portion 15*a* of the tubular cap, in opening 17 present in base 18 of the tank central orifice C of the tubular cap 15 constitutes the evacuation orifice of the tank. Water tightedness between the base 18 of the tank and the base plate or support surface of the tubular cap 15 is achieved by means of an intermediate annular joint 19 made of rubber or any other adequate material.

The base of the external bell 3 and the tubular cap 15 are arranged in a complementary manner, or provided with complementary junction means enabling them to be rigidily assembled, in a removable manner, and at the same time enabling the passage of water between the base and the tubular cap. The tubular cap 15 is, for example, provided with three guiding and latching forks 20 spaced at 120° from each other and between whose branches the base of the external bell 3 is engaged and retained. The internal branches of these latching forks 20 and collar 20*b* to which they are attached by their peak, being provided with vertical ribs 20*c* acting as guides to float 6, during its vertical movements.

According to the invention, the float is equipped with a blocking device 21, which is axially and vertically movable, and able to be applied against its seat, constituted by the edge of the lower orifice D of the overflow tube 4, under the pressure of the rocking element 13 enabling the lifting of valve 5, or under the pressure of water leaving the tank, and thus ensuring the buoyancy of the float. On the other hand, the transmission rod 12 is equipped with a pusher element 22 enabling the lowering of blocking device 21 and the opening of the lower orifice D, when float 6 is in a lifted floating position, so as to enable entry of water in the float, bringing about the submersion of the latter and the falling back of valve 5 on its seat 16.

The pusher element 22 is, for example, constituted by a ring wedged on the transmission rod 12, in its lower portion.

The blocking device 21 advantageously comprises a tubular body 23, preferably cylindrical, whose peak is closed by an upper wall 24 in which a hole 25 is arranged for the passage of transmission rod 12. At its base, the tubular body 23 is provided with a capsular flange 26 constituting a valve whose seat is constituted by the lower surface of mounting device 4a of valve 5, demarcating the lower opening D of the overflow tube 4. This valve 26 may be formed in a single piece with the tubular body.

Internally, the body 23 of blocking device 21 comprises at least one, and preferably two vertical partitions 27, that are parallel and divide the internal space of the body into several chambers, for examples, three chambers 28, 29, 30. The intermediate chamber 29 comprises a hole 25 for the passage of the transmission rod, whereas the other two lateral chambers 28, 30, of equal volume and arranged symmetrically on each side of chamber 29, are closed in a sealed manner at their peaks by wall 24, and thus constitute air pockets that increase the floatibilty of blocking device 21 and of float 6.

Figure 5:
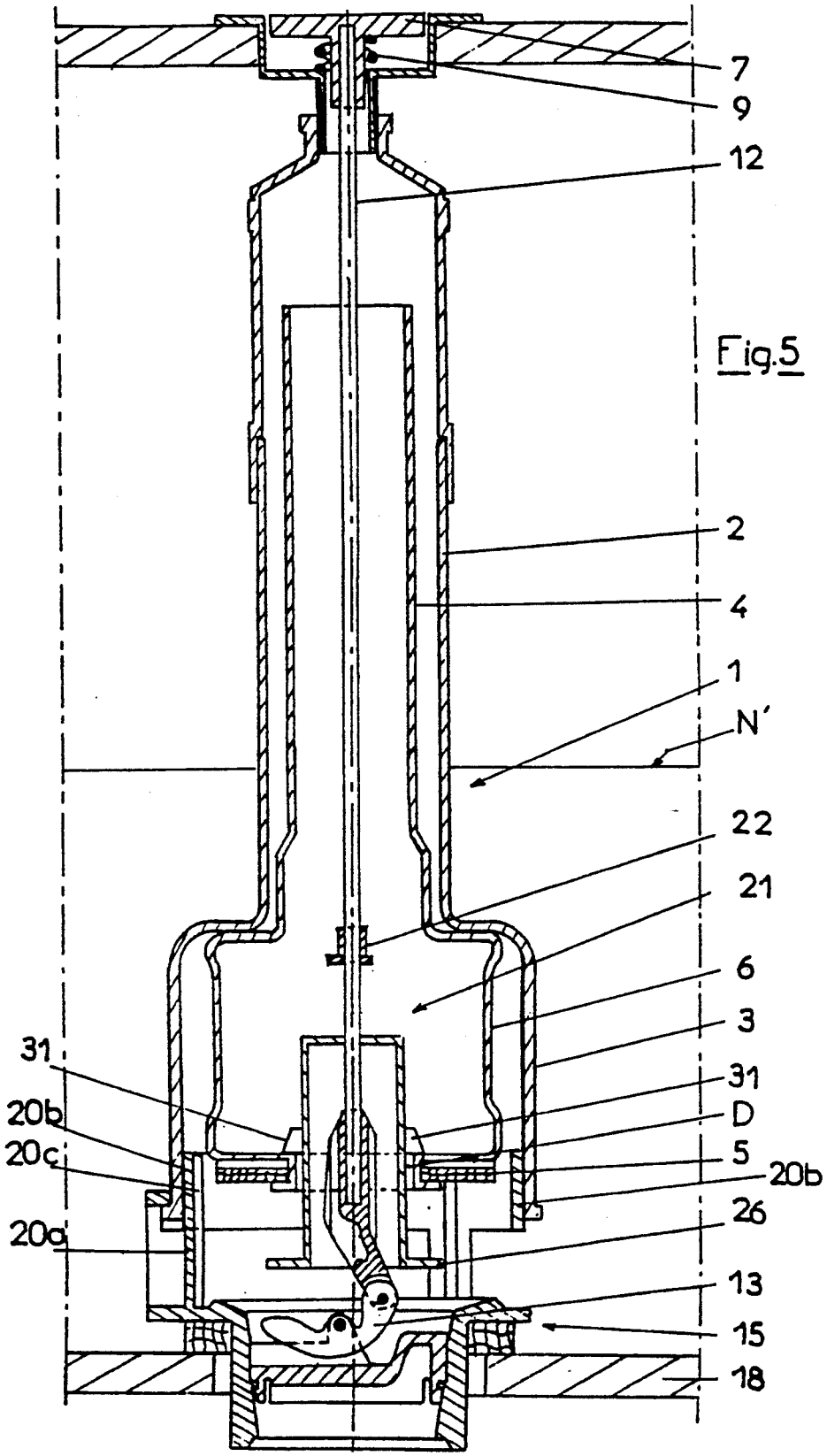
FIG. 5 is a view similar to the preceding one, showing the mobile equipment before it falls, and after the push button has been released.

The body 23 is provided, externally and laterally, with abutment wings 31, arranged at a distance from the capsular flange 26. These abutment wings are housed in the float 6, and, when blocking device 21 is distanced from its seat, they come in abutment against the internal edge of orifice D (FIG. 5). When the mobile equipment is in a raised position, during evacuation, because of its buoyancy, and when the push button is pressed to interrupt evacuation, the presence of the abutment wings limit the descending path of blocking device 21, and the movement of the water rushing towards evacuation orifice C acts on the upper surface of the capsular flange 26 and contributes to the acceleration of the falling movement of the mobile equipment and the closure of the orifice.

Figure 6:
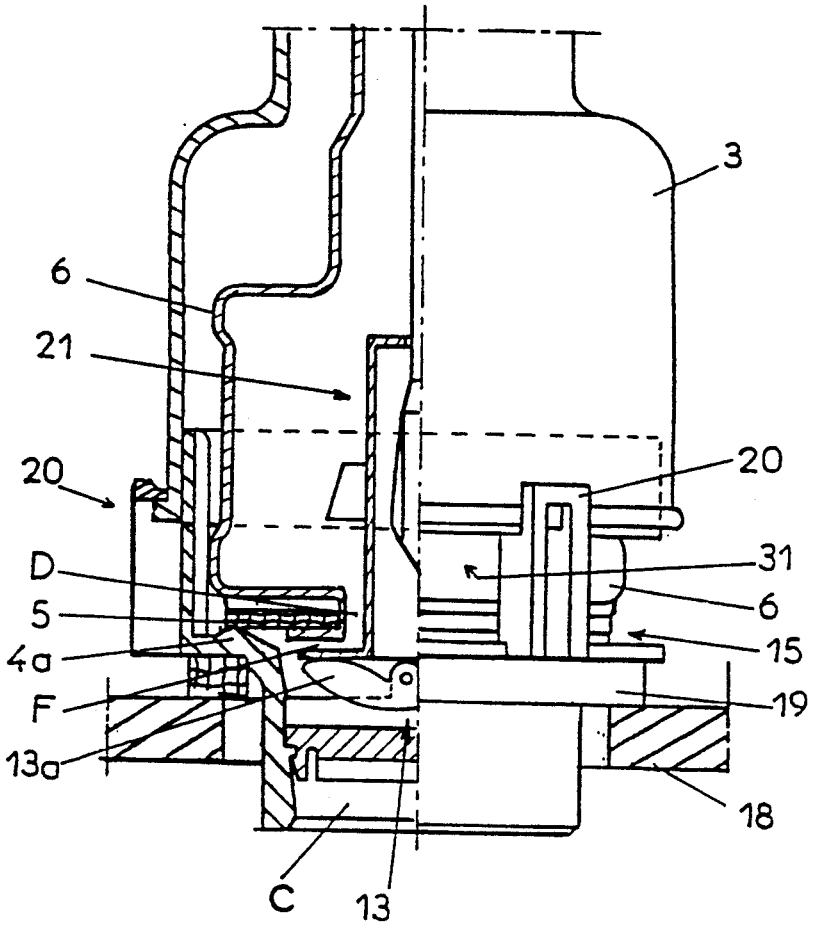
FIG. 6 is partial, semi-sectional axial view of the lower portion of the flushing mechanism represented in the rest or closure position of the mechanism.

Seat 16 of valve 5 and the upper edge of the resistance arm 13a of rocking lever 13 are positioned in a reciprocal manner, such that when the mobile equipment constituted by the overflow tube 4, the float 6, and valve 5, are in a lowered inactive position, they rest, by means of the lower surface of the valve, on the edge of evacuation orifice C, whereas the capsular flange 26 is found slightly distanced from its seat 4a, so as to reserve a space F between it and the seat, and to open the lower overflow orifice D, the capsular flange resting on the upper edge of the resistance arm 13a of the rocking lever 13. This arrangement is especially represented in FIG. 6.

The functioning of the flushing mechanism according to the invention will be described below.

In the filling or inactive period (FIG. 1), the mobile equipment 4-5-6 of the mechanism is in a lowered position, the valve 5 rests on its seat and blocks the evacuation orifice C, and the control push button 7 and the pusher ring 22 are in a raised position. At the end of the filling, the level N of the water contained in the tank is generally a little below the position at which the upper end of the overflow tube 4 is located, and it can fulfill its function in case of defective closing of the supply tap. Water also fills spaces A and B.

Figure 2:
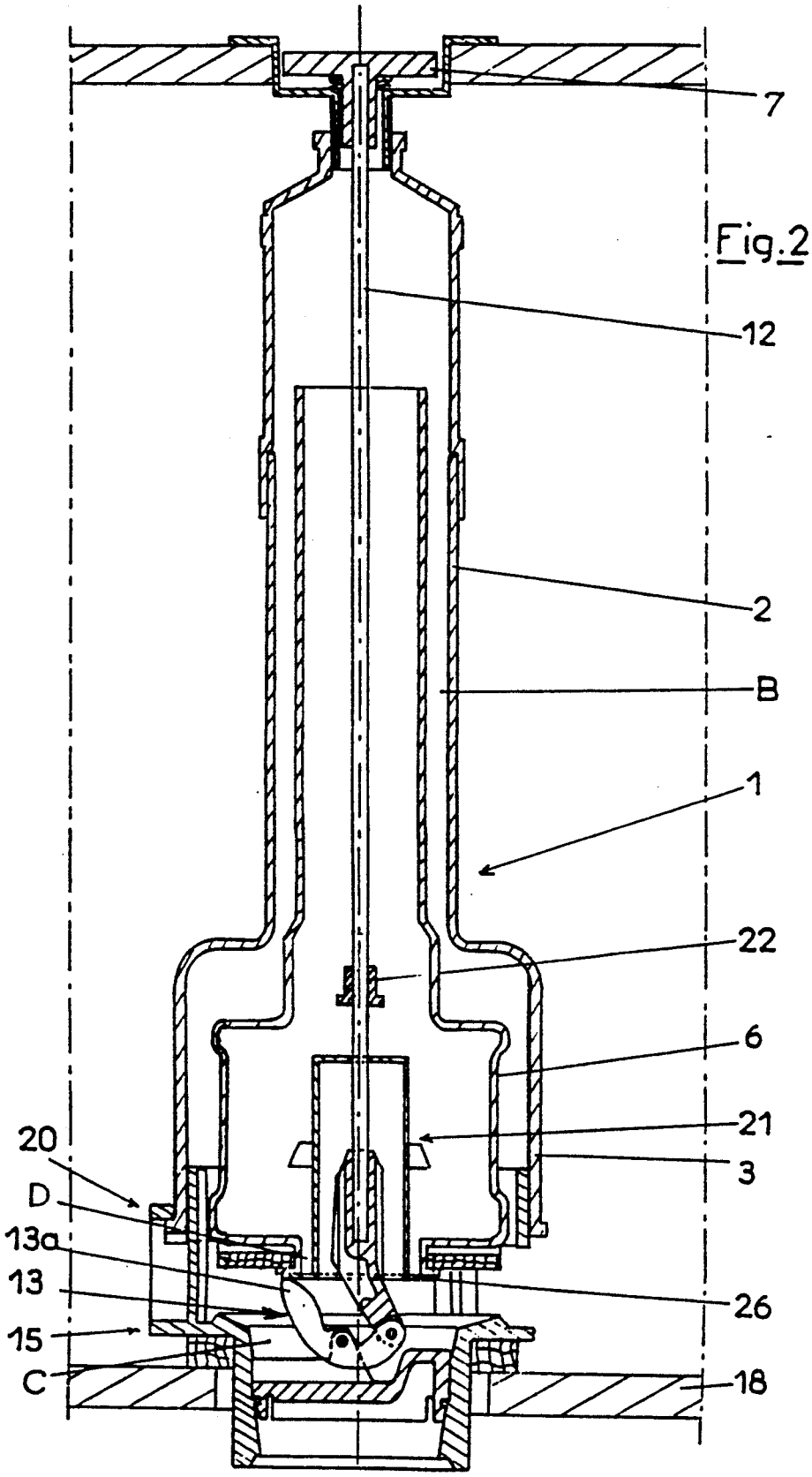
FIG. 2 is a view similar to FIG. 1, and represents the lifting of the valve and the beginning of the ascending path of the float, resulting from the pushing of the control push button.

By pressing on push button 7, one brings about the lowering of transmission rod 12 and rocking of lever 13 whose resistance arm 13a pivots upwardly and brings about, firstly, the lifting of blocking device 21 that closes orifice D, and secondly the lifting of valve 5 and the mobile equipment 4-5-6. Water rushes towards the evacuation orifice C through openings arranged between the base of bell 3 and the upper surface of tubular cap 15, and, by passing under float 6, communicates an additional lifting movement to the float whose upward displacement is stopped by the pusher ring 22 against which peak 24 of the blocking device 21 abuts (FIG. 2), the latter remaining applied against its seat under the effect of water pressure that cannot enter the float.

Figure 3:
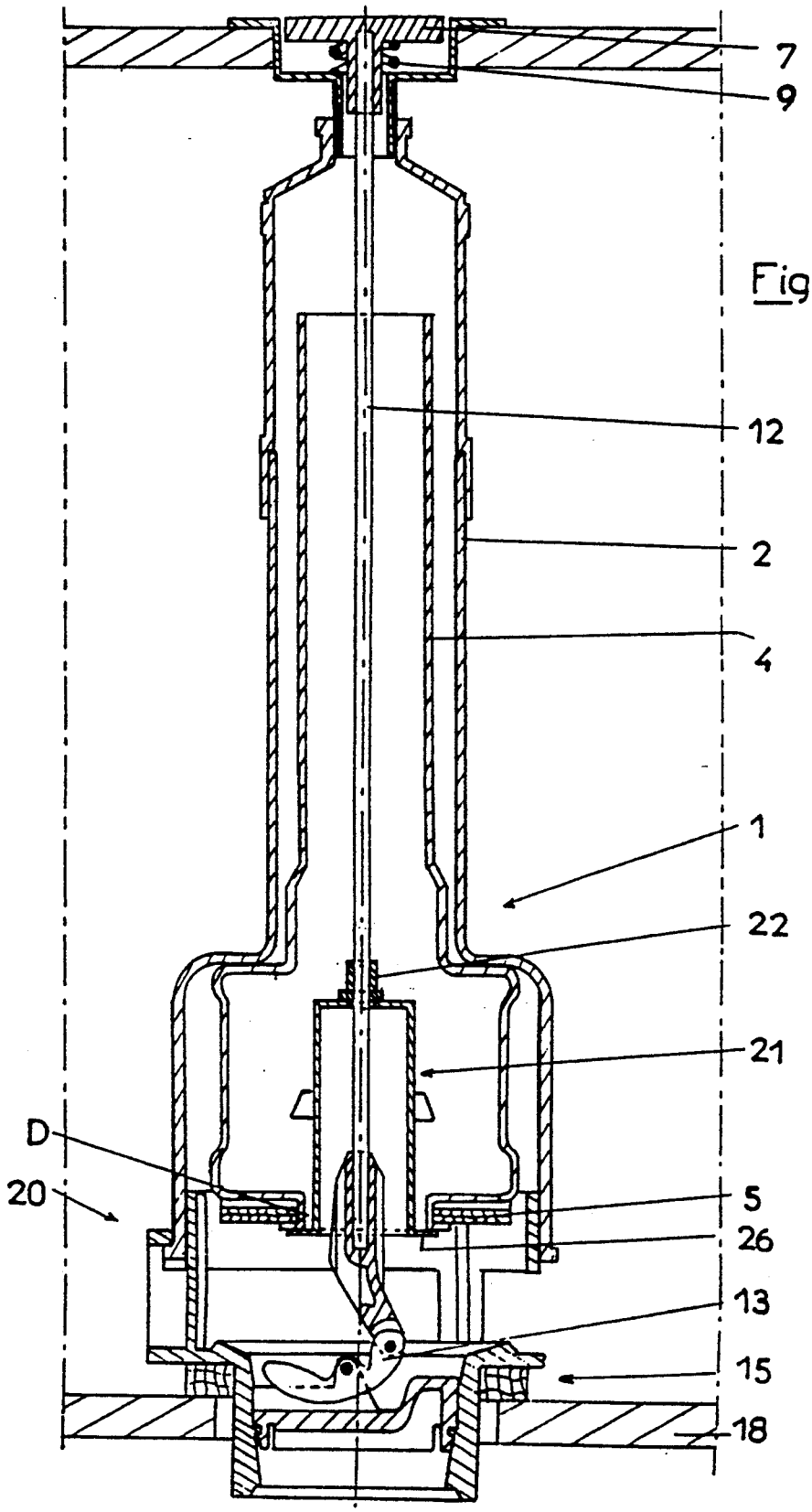
FIG. 3 is a view similar to FIGS. 1 and 2, and represents the mobile equipment in the elevated buoyant position, and the return to the resting position of the mobile elements of the control device, after the push button has been released.

When the push button 7 is released, it ascends under the action of spring 11, and effects a corresponding ascending movement of the transmission rod 12, and of the pusher ring 22. Also the rocking lever 13 once again takes its initial position (FIG. 3). The float 6 and its blocking device 21 accompany the rod 12 and pusher ring 22 in their upward movement.

During a total evacuation of the tank, the mobile equipment 4-5-6 remains in a raised position as long as the buoyancy of the float remains ensured. At the end of the evacuation, the level of water progressively decreases, and the mobile equipment 4-5-6 naturally falls back to its resting position (FIG. 1) when there is no longer any water in the tank and the buoyancy of float 6 is no longer ensured.

Figure 4:
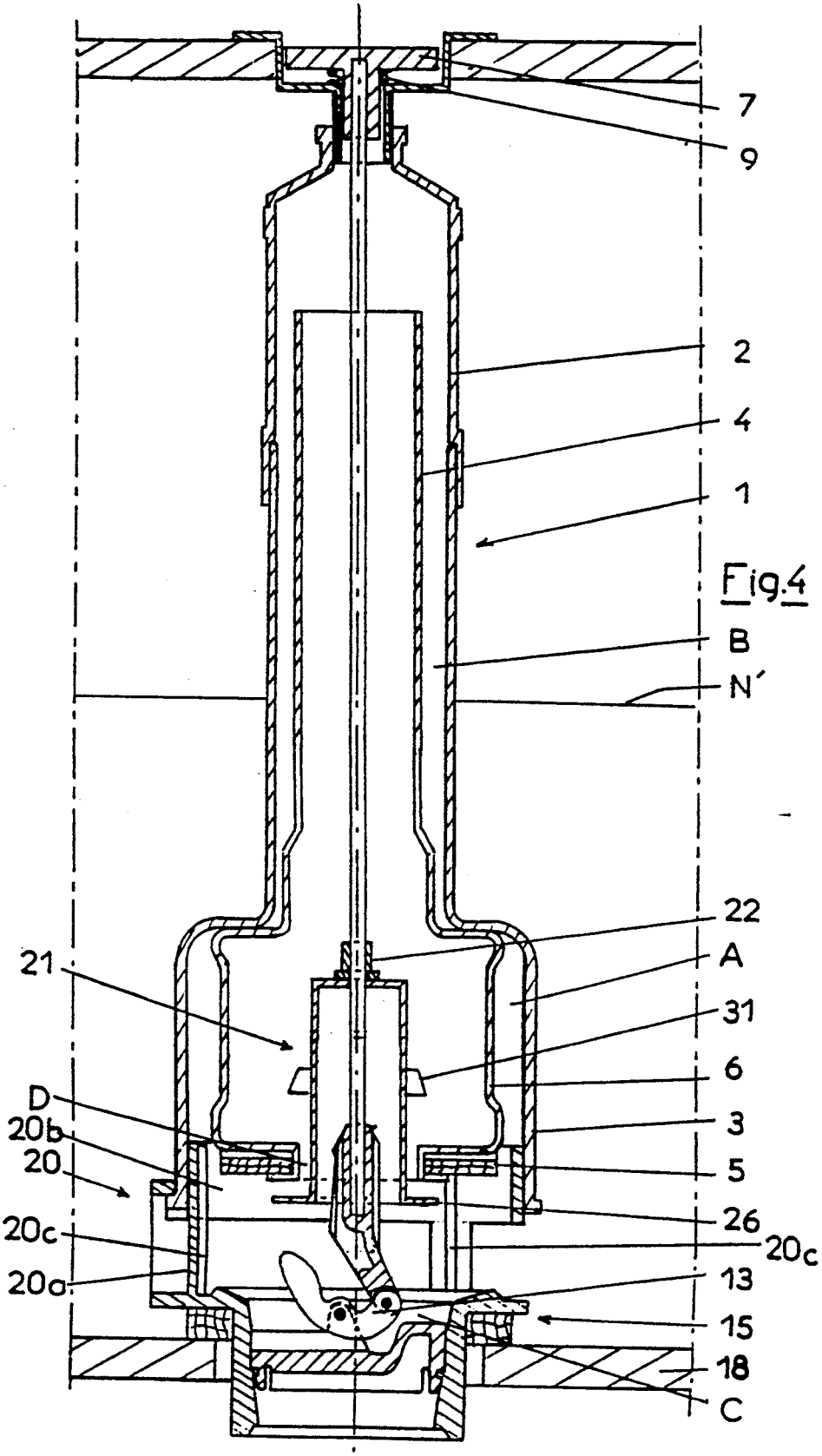
FIG. 4 is an axial sectional view showing the lowering of the mobile base of the float so as to bring about the fall of the valve and the interruption of the evacuation process of the tank.

When one wishes to interrupt the evacuation when level N' of the water is at any intermediate level, one presses a push button 7, and this brings about the lowering of the transmission rod 12 and the pusher ring 22, which presses on peak 24 of blocking device 21, which is then displaced towards the base (FIG. 4). The capsular flange is distanced from its seat and the lower orifice D of the float being open, is filled with water. After the push button is released (FIG. 5), the mobile equipment 4-5-6 falls back, and valve 5 comes to rest on its seat totally interrupting the outflow to the position illustrated in FIG. 1).

This operation may be repeated several times during a single evacuation, and may be done at any moment whatsoever.

What is claimed:

1. Flushing mechanism, comprising:

an eternal tubular envelope;

an axially displaceable member positioned within said external tubular envelope comprising an evacuation tube having an upper portion having a first opening and a lower portion having a second opening; a first valve for blocking an evacuation orifice of a flushing tank positioned on said lower portion of said evacuation tube; said lower portion of said evacuation tube comprising a float arranged above said first valve; and said float including a first seat surrounding said second opening;

means for lifting said first valve comprising a push button; a transmission rod transversing said axially displaceable member connected to said push button; a pusher element affixed to said transmission rod; a lifting element for lifting said axially displaceable member; and a joint attaching said lifting element to a lower portion of said transmission rod;

an axially displaceable blocking element movably mounted within said float; said axially displaceable blocking element being constructed and arranged to be applied against said first seat when said means for lifting is displaced by pushing said push button or under pressure of water being evacuated through the evacuation orifice, and to be spaced from said first seat by actuation of said pusher element so as to enable entry of water into said float so that the float is displaced and said first valve seals said evacuation orifice.

2. The flushing mechanism according to claim 1, wherein said axially displaceable blocking element comprises a tubular body having a base, and a second valve on said base.

3. The flushing mechanism according to claim 2, wherein said second valve comprises a capsular flange.

4. The flushing mechanism according to claim 3, wherein said tubular body is positioned in side said float.

5. The flushing mechanism according to claim 4, wherein said tubular body is positioned within said second opening.

6. The flushing mechanism according to claim 5, wherein said tubular body comprises a top wall including a third opening for passage of said transmission rod.

7. The flushing mechanism according to claim 6, wherein said tubular body comprises at least one vertical partition defining at least one chamber forming an air pocket within said tubular body.

8. The flushing mechanism according to claim 7, wherein said tubular body comprises two chambers forming air pockets.

9. The flushing mechanism according to claim 8, wherein said two chambers are symmetrically positioned on opposite sides of an intermediate chamber through which said transmission rod passes.

10. The flushing mechanism according to claim 9, wherein said two chambers are identical.

11. The flushing mechanism according to claim 4, wherein said tubular body comprises external, lateral abutment wings for limiting a vertical path of movement of said tubular body with respect to said float.

12. The flushing mechanism according to claim 11, wherein said tubular body comprises a top wall including a third opening for passage of said transmission rod.

13. The flushing mechanism according to claim 12, wherein said tubular body comprises at least one vertical partition defining at least one chamber forming an air pocket within said tubular body.

14. The flushing mechanism according to claim 13, wherein said tubular body comprises two chambers forming air pockets.

15. The flushing mechanism according to claim 5, wherein said tubular body comprises external, lateral abutment wings for limiting a vertical path of movement of said tubular body with respect to said second opening.

16. The flushing mechanism according to claim 15, wherein said tubular body comprises a top wall including a third opening for passage of said transmission rod.

17. The flushing mechanism according to claim 16, wherein said tubular body comprises at least one vertical partition defining at least one chamber forming an air pocket within said tubular body.

18. The flushing mechanism according to claim 17, wherein said tubular body comprises two chambers forming air pockets.

19. The flushing mechanism according to claim 1, wherein said pusher element comprises a ring fixed on said transmission rod.

20. The flushing mechanism according to claim 1, wherein said first valve includes a second seat and said lifting element includes a n upper edge, and said second seat and said upper edge are reciprocally positioned so that, at rest, said axially displaceable blocking element is located at a slight distance from said first seat.

* * * * *